US008533893B2

(12) United States Patent
Sayeed

(10) Patent No.: US 8,533,893 B2
(45) Date of Patent: Sep. 17, 2013

(54) DISPOSABLE TOOTHBRUSH

(76) Inventor: Mohammed Sharafatullah Sayeed, Bolingbrook, IL (US)

( * ) Notice: Subject to any disclaimer, the term of this patent is extended or adjusted under 35 U.S.C. 154(b) by 0 days.

(21) Appl. No.: 12/911,921

(22) Filed: Oct. 26, 2010

(65) Prior Publication Data

US 2012/0096664 A1 Apr. 26, 2012

(51) Int. Cl.
*A46B 9/04* (2006.01)

(52) U.S. Cl.
USPC ..... 15/167.1; 15/207.2

(58) Field of Classification Search
USPC ..... 15/167.1, 207.2
See application file for complete search history.

(56) References Cited

U.S. PATENT DOCUMENTS 2,251,853 A * 8/1941 Pandiyan ..... 15/176.2
3,010,131 A * 11/1961 Kisky ..... 15/167.1
4,462,136 A * 7/1984 Nakao et al. ..... 15/167.1
5,054,154 A * 10/1991 Schiffer et al. ..... 15/167.1
5,939,049 A * 8/1999 Miller et al. ..... 424/49
6,490,747 B1 * 12/2002 Metwally ..... 15/22.1
7,074,390 B2 * 7/2006 MacKinnon ..... 424/49
8,141,195 B2 * 3/2012 Al-Sulaiman et al. ..... 15/176.1

* cited by examiner

*Primary Examiner* — Randall Chin
(74) *Attorney, Agent, or Firm* — Richards Patent Law P.C.

(57) ABSTRACT

A single-use, disposable toothbrush offering the dental hygiene benefits of a miswak chewing stick. The toothbrush has a toothbrush body having a recess at one end thereof, and a piece of cut and flared *Salvadora persica* bristles received in the recess; the length of the bristles is greater than the depth of the recess so that the bristles extend from the toothbrush body. The toothbrush body has a handle at an end thereof opposite the recess; the handle may have a concave portion to provide convenient handling for a user. The bristles are press-fitted into the recess. The toothbrush body may advantageously be formed of a biodegradable material, so that the entire toothbrush is biodegradable. In addition, the bristles may have a flavoring.

7 Claims, 3 Drawing Sheets

DISPOSABLE TOOTHBRUSH

FIELD OF THE DISCLOSURE

This disclosure relates to dental hygiene, and more particularly to a toothbrush with biodegradable bristles suitable for a single use.

BACKGROUND OF THE DISCLOSURE

Twigs of the arak or mustard tree (*Salvadora persica*) have long been used as a dentifrice. Twigs typically one hand span in length and suitable for chewing, known as the miswak, are known in Middle Eastern and South Asian cultures; in particular, the benefits of chewing the miswak are documented in Islamic literature. More recent studies suggest that the miswak is an anti-plaque agent, prevents gum disease, can aid in smoking cessation, and has a positive effect on the immune system. The World Health Organization (WHO) recommended the use of the miswak in 1986.

The miswak is much less well known in Western cultures, where generally a dentifrice is brushed over the teeth rather than chewed. It is desirable to adapt the miswak to a toothbrush which can be conveniently used and carried, and discarded after a single use.

SUMMARY OF THE DISCLOSURE

The present disclosure provides a single-use, disposable toothbrush offering the dental hygiene benefits of a miswak chewing stick. According to an aspect of the disclosure, the toothbrush has a toothbrush body having a recess at one end thereof, and a plurality of *Salvadora persica* bristles received in the recess; the length of the bristles is greater than the depth of the recess so that the bristles extend from the toothbrush body. The toothbrush body has a handle at an end thereof opposite the recess; the handle may have a concave portion to provide convenient handling for a user. The bristles are press-fitted into the recess.

The toothbrush body may advantageously be formed of a biodegradable material, so that the entire toothbrush is biodegradable. In addition, the bristles may have a flavoring.

The foregoing has outlined, rather broadly, the preferred features of the present disclosure so that those skilled in the art may better understand the detailed description of the disclosure that follows. Additional features of the disclosure will be described hereinafter that form the subject of the claims of the disclosure. Those skilled in the art should appreciate that they can readily use the disclosed conception and specific embodiment as a basis for designing or modifying other structures for carrying out the same purposes of the present disclosure and that such other structures do not depart from the spirit and scope of the disclosure in its broadest form.

DETAILED DESCRIPTION

In embodiments of the disclosure, a toothbrush that has cut and flared pieces of Miswak (hereby called "Miswak bristles") forming the toothbrush bristles at one end of the toothbrush, and a convenient handle at the other end. The entire toothbrush may be discarded after a single use. The miswak bristles, being made from plant material, are biodegradable. The body of the toothbrush may advantageously also be biodegradable (e.g. made from biodegradable plastic).

Figure 1:
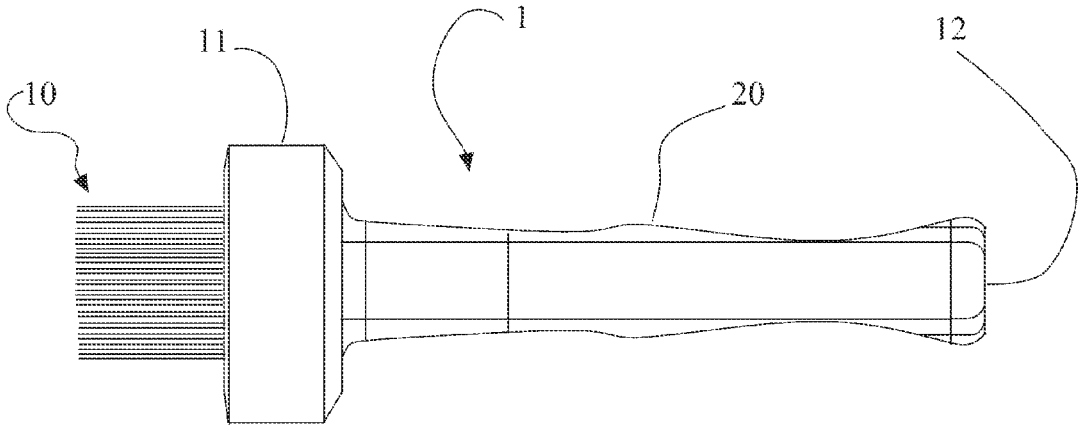
FIG. 1 is a side view of a toothbrush embodying the present disclosure.

FIG. 1 is a side view of a toothbrush with miswak bristles, according to an embodiment of the disclosure. Toothbrush 1 has bristles 10 at one end of toothbrush body 20. The bristles are fitted into a head portion 10 of the toothbrush body; a handle 12 forms the opposite end. In this embodiment, the head portion 10 has cylindrical symmetry, and the bristles, head portion and handle are along the longitudinal axis of the toothbrush body. Alternatively, the toothbrush body may also be configured so that the bristles are at an angle to the handle. In another embodiment, the bristles extend from the toothbrush body at right angles to the longitudinal axis of the toothbrush body.

Compared to a traditional miswak chewing stick, the toothbrush bristles are short; in the embodiment shown in FIG. 1, the bristles are approximately ¾ inch long overall, with approximately ½ inch extending forward from the head portion. Each bristle also has a much smaller diameter than a chewing stick.

Figure 2A:
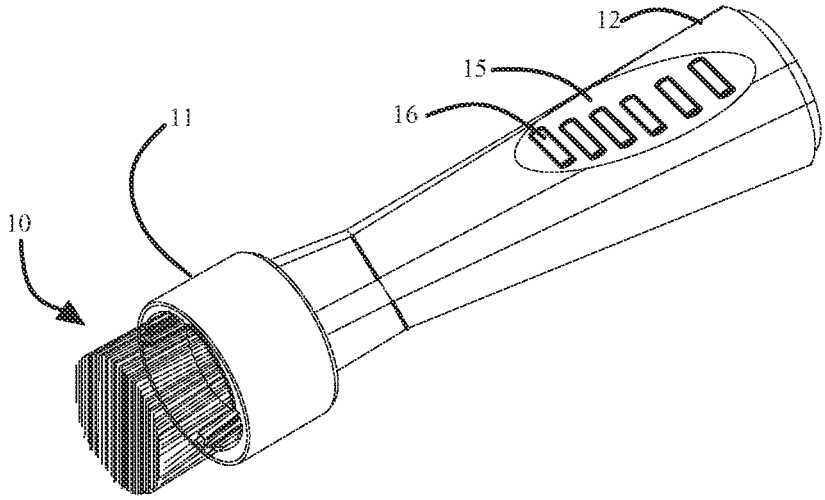
FIG. 2A is a perspective view of the toothbrush of FIG. 1, showing further details of the toothbrush handle.

FIG. 2A is a perspective view of the toothbrush of FIG. 1, showing more details of the head portion 11 and handle 12. The bristles 10 are received into a recess in the head portion 11. Handle 12 is configured to provide a convenient grip for the user. The handle is slightly flattened; that is, the end of handle 12 opposite the head portion is oval in shape. Handle 12 has concave portions 15 on opposite sides thereof; one such concave portion is shown in FIG. 2A. Concave portion 15 may have small raised areas or knobs 16.

Figure 2B:
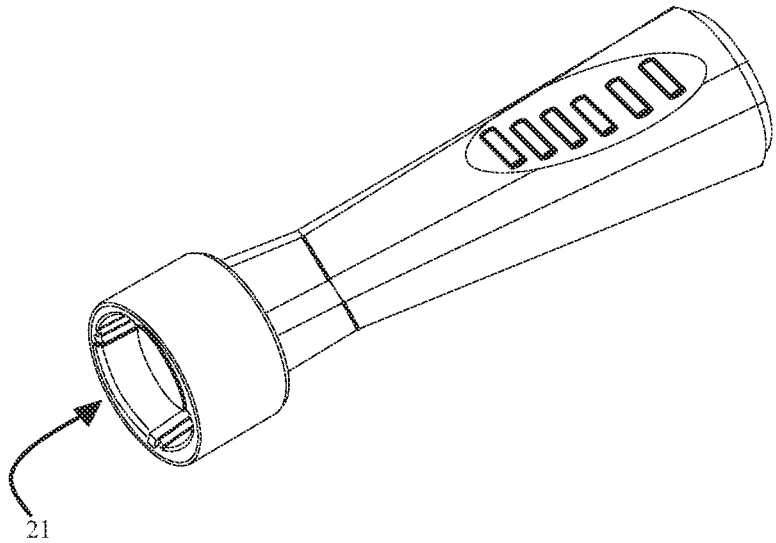
FIG. 2B shows the handle of the toothbrush of FIG. 2A, without bristles.

FIG. 2B is a perspective view of the toothbrush body 20. As best shown in FIG. 2B, head portion 11 has a recess 21 formed therein for receiving bristles 10. Although in this embodiment the head portion 10 is cylindrical, recess 21 need not be cylindrical. The shape and depth of the recess are chosen to hold the bristles tightly in the head portion. As shown in FIG. 2B, recess 21 has four lobes; the four intersections of the lobes form edges extending along the axis of the head portion and intruding radially into the recess. The bristles 10 are typically press-fitted into the recess. A bristle falling out of the recess during use may simply be spat out. Although miswak naturally imparts a pleasant fragrance in the mouth, the bristles may be treated with a natural flavoring (e.g. mint).

Figure 3A:
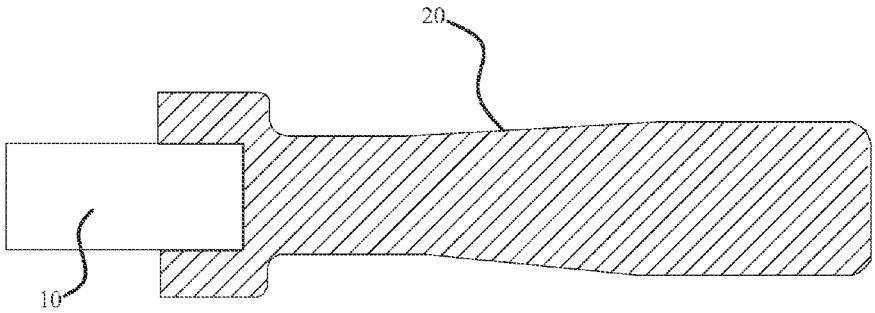
FIG. 3A is a cross-sectional view of a toothbrush in accordance with an embodiment of the disclosure.
Figure 3B:
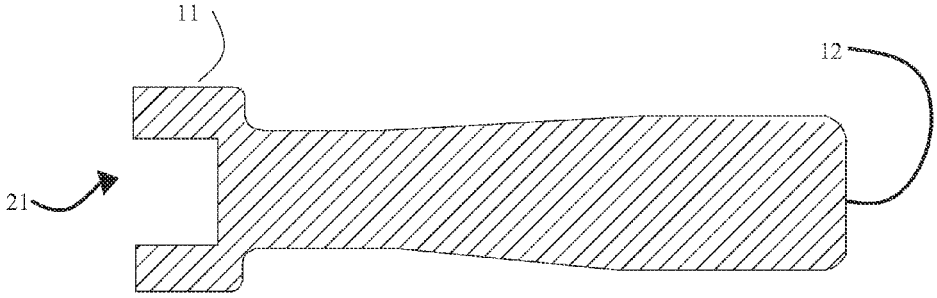
FIG. 3B is a cross-sectional view showing the handle of the toothbrush of FIG. 3A, without bristles.

FIGS. 3A and 3B are cross-section views of the toothbrush and toothbrush body, respectively, in accordance with this embodiment. As shown in FIGS. 3A and 3B, recess 21 in head portion 11 has a depth approximately half the length of the bristles 10, to minimize the number of bristles falling out during use.

It will be appreciated that numerous other configurations of the toothbrush body are possible. For example, the forward end of the handle, adjacent the head portion, may have a right-angle bend so that the bristles extend from the head portion at right angles to the handle.

While the disclosure has been described in terms of specific embodiments, it is evident in view of the foregoing description that numerous alternatives, modifications and variations will be apparent to those skilled in the art. Accordingly, the disclosure is intended to encompass all such alternatives, modifications and variations which fall within the scope and spirit of the disclosure and the following claims.

What is claimed is:

1. A toothbrush comprising:

an elongate toothbrush body having a recess at one end thereof, the toothbrush body defining an axis along its length, wherein the recess includes an opening facing parallel to the toothbrush body axis; and a plurality of bristles that are cut and flared pieces of Miswak received in the recess, the length of the bristles being greater than the depth of the recess so that the bristles extend from the toothbrush body such that each bristle includes an unexposed portion located within the recess and an exposed portion extending from the toothbrush body, wherein each of the plurality of bristles are flared from each other along the entire length of the exposed portion of each bristle, wherein the bristles consist essentially of plant material from *Salvadora persica*, wherein the bristles are press-fitted into the recess, wherein the toothbrush body has a cylindrical head portion including the recess, and the recess is non-cylindrical.

2. A toothbrush according to claim 1, wherein the toothbrush body has a handle at an end thereof opposite the recess, the handle having at least one concave portion to provide convenient handling for a user.

3. A toothbrush according to claim 1, wherein the toothbrush is disposable after a single use.

4. A toothbrush according to claim 3, wherein the toothbrush body is formed of a biodegradable material.

5. A toothbrush according to claim 1, wherein the bristles have a flavoring.

6. A toothbrush according to claim 1, wherein the toothbrush body has a head portion including the recess and a handle at an end opposite the recess, and the bristles, head portion and handle are along a longitudinal axis of the toothbrush body.

7. A toothbrush according to claim 1, wherein the toothbrush body has a head portion including the recess and a handle at an end opposite the recess, and the bristles extend from the toothbrush body at an angle to the longitudinal axis of the toothbrush body.

* * * * *